US007444911B2

(12) United States Patent
Sanda et al.

(10) Patent No.: US 7,444,911 B2
(45) Date of Patent: Nov. 4, 2008

(54) SLITTER BLADE ASSEMBLY

(75) Inventors: Akihiro Sanda, Minamiashigara (JP); Sampei Iida, Minamiashigara (JP); Kenji Watanabe, Minamiashigara (JP); Fujio Kuwabara, Minamiashigara (JP)

(73) Assignee: FUJIFILM Corporation, Tokyo (JP)

( * ) Notice: Subject to any disclaimer, the term of this patent is extended or adjusted under 35 U.S.C. 154(b) by 53 days.

(21) Appl. No.: 09/843,765

(22) Filed: Apr. 30, 2001

(65) Prior Publication Data

US 2001/0052279 A1 Dec. 20, 2001

(30) Foreign Application Priority Data

May 1, 2000 (JP) ..... 2000-133015

(51) Int. Cl.
*B26D 1/24* (2006.01)

(52) U.S. Cl. ..... 83/425.2; 83/500; 83/505

(58) Field of Classification Search ..... 83/500, 83/676, 505, 425.2, 430, 948; 101/226; 30/357
See application file for complete search history.

(56) References Cited

U.S. PATENT DOCUMENTS 3,122,958 A * 3/1964 Washburn ..... 83/500
3,292,478 A * 12/1966 Falk et al. ..... 83/679
3,312,135 A * 4/1967 Mraz ..... 83/675
3,674,065 A * 7/1972 Fairfield et al. ..... 83/594
3,727,503 A * 4/1973 Braner et al. ..... 83/498
3,788,180 A * 1/1974 Potsch et al. ..... 83/449
4,245,534 A * 1/1981 Van Cleave ..... 83/500
4,275,631 A * 6/1981 Wingen ..... 83/698.41
4,414,874 A * 11/1983 Barnes et al. ..... 83/488
4,643,060 A * 2/1987 Fremion ..... 83/675
4,662,259 A * 5/1987 Dutina ..... 83/835
4,972,750 A * 11/1990 Paavola ..... 83/500
5,058,475 A * 10/1991 Tidland et al. ..... 83/500
5,365,821 A * 11/1994 Munier et al. ..... 83/500
5,423,239 A * 6/1995 Sakai et al. ..... 83/56
5,423,240 A * 6/1995 DeTorre ..... 83/500
5,836,229 A * 11/1998 Wakayama et al. ..... 83/676
5,974,922 A * 11/1999 Camp et al. ..... 83/37
6,033,057 A * 3/2000 Takagi ..... 347/55
6,205,898 B1 * 3/2001 Surina ..... 83/76
6,258,410 B1 * 7/2001 Annoura et al. ..... 427/289

(Continued)

FOREIGN PATENT DOCUMENTS

EP 994054 A2 * 4/2000

(Continued)

OTHER PUBLICATIONS

Patent Abstract of Japan, 01246094 A, Oct. 2, 1989.
Patent Abstract of Japan, 07272270 A, Oct. 20, 1995.
Office Action for Patent Application No. 2000-133015 in Japan Patent Office, dated Aug. 28, 2007.

*Primary Examiner*—Jason Prone
(74) *Attorney, Agent, or Firm*—Sughrue Mion, PLLC

(57) ABSTRACT

A disk-shaped rotary blade of a slitter blade assembly has a cutting edge and a first beveled surface facing a drum-shaped rotary blade of the slitter blade assembly and progressively spaced from the drum-shaped rotary blade toward the cutting edge. The disk-shaped rotary blade also has a second beveled surface facing a workpiece to be cut off and progressively spaced from the cutting edge away from the workpiece.

14 Claims, 8 Drawing Sheets

U.S. PATENT DOCUMENTS

| | | | | |
|---|---|---|---|---|
| 6,267,033 | B1 * | 7/2001 | Gundlach et al. | 83/42 |
| 6,357,691 | B1 * | 3/2002 | Watanabe et al. | 242/545.1 |
| 6,408,729 | B1 * | 6/2002 | Johnson | 83/697 |
| 6,427,572 | B2 * | 8/2002 | Ciani et al. | 83/676 |
| 6,464,162 | B2 * | 10/2002 | Watanabe et al. | 242/545.1 |
| 6,820,784 | B2 * | 11/2004 | Gao et al. | 83/500 |
| 6,874,396 | B2 * | 4/2005 | Sanda | 83/102 |
| 7,051,911 | B2 * | 5/2006 | Lai et al. | 83/675 |
| 7,143,674 | B2 * | 12/2006 | Lai et al. | 83/675 |
| 2001/0023690 | A1 * | 9/2001 | Lee et al. | 83/835 |
| 2002/0038594 | A1 * | 4/2002 | Maekawa et al. | 83/676 |
| 2002/0166424 | A1 * | 11/2002 | Takahashi | 83/948 |
| 2003/0129376 | A1 * | 7/2003 | Lai et al. | 428/304.4 |
| 2003/0131699 | A1 * | 7/2003 | Lai et al. | 83/500 |

FOREIGN PATENT DOCUMENTS

| | | | |
|---|---|---|---|
| EP | 1348657 | A1 * | 10/2003 |
| JP | 64-027891 | A | 1/1989 |
| JP | 01-246094 | A | 10/1989 |
| JP | 7-67675 | | 7/1995 |
| JP | 7-272270 | | 10/1995 |

* cited by examiner

SLITTER BLADE ASSEMBLY

BACKGROUND OF THE INVENTION

1. Field of the Invention

The present invention relates to a slitter blade assembly comprising a drum-shaped rotary blade and a disk-shaped rotary blade, for cutting off a thin flat workpiece such as a film or the like.

2. Description of the Related Art

Rotary blade assemblies for cutting off thin flat workpieces including films, sheets of paper, metal foils, etc., for example, generally comprise an upper blade and a lower blade which rotate in respective opposite directions while their circumferential edges are being held in sliding contact with each other, for continuously cutting of the thin flat workpiece. The shape of cutting edges on a rotary blade greatly affects the quality of severed surfaces on the workpiece.

Japanese patent publication No. 7-67675 discloses a conventional rotary blade assembly comprising upper and lower circular blades whose cutting edges are progressively beveled away from the companion blades to give severed surfaces a desired shape. The disclosed rotary blade assembly is suitable for cutting off a film having a base of TAC (triacetyl cellulose), for example.

Some films that have been developed in recent years have a base of PEN (polyethylene naphthalate). The PEN has such properties that it cannot easily be ruptured because of high mechanical strength and can easily be stretched. When the conventional rotary blade assembly is applied to the cutting of a film having a PEN base, depending on the beveled edge settings, as shown in FIG. 6 of the accompanying drawings, severed surfaces 3*a*, 3*b* of a base 2 which supports an emulsion layer 1 may suffer a crack 4 or a whisker 5, tending to lower the quality of the severed film.

Another conventional rotary blade assembly which is capable of well cutting off a PEN base is revealed in Japanese laid-open patent publication No. 7-272270. As shown in FIG. 7 of the accompanying drawings, the revealed rotary blade assembly has an upper blade 6 including a tapered surface 8 contiguous to a cutting edge 7. When the tapered surface 8 is pressed against an emulsion layer 1 and a base 2 that are placed on a lower blade 9, internal stresses are developed in the emulsion layer 1 and the base 2 under tensile forces prior to the severance of the emulsion layer 1 and the base 2. Thereafter, the emulsion layer 1 and the base 2 are cut off by the cutting edge 7. In this manner, the emulsion layer 1 and the base 2 can be cut off with good severed surfaces 3*a*, 3*b*.

However, since the tapered surface 8 of the upper blade 6 is pressed against the emulsion layer 1 when the emulsion layer 1 and the base 2 are severed, an edge 10 of the upper blade 6 remote from the cutting edge 7 presses the emulsion layer 1, tending to apply a striped mark to the emulsion layer 1.

SUMMARY OF THE INVENTION

It is a general object of the present invention to provide a slitter blade assembly which is capable of cutting off a workpiece into products of high quality.

A primary object of the present invention is to provide a slitter blade assembly which is capable of cutting off a thin workpiece into products of high quality without causing damage to the thin workpiece.

Another primary object of the present invention is to provide a slitter blade assembly which is capable of cutting off a workpiece that is of high mechanical strength and is easily stretchable into products of high quality.

Still another primary object of the present invention is to provide a slitter blade assembly which comprises rotary blades that are prevented from suffering the attachment of severed debris thereto and that will maintain a cutting capability over a long period of time.

Another object of the present invention is to provide a slitter blade assembly which is preventing from chipping and hence has a long service life.

According to an aspect of the present invention, there is provided a slitter blade assembly for cutting off a workpiece, comprising a drum-shaped rotary blade and a disk-shaped rotary blade, the disk-shaped rotary blade having a cutting edge, a first beveled surface facing the drum-shaped rotary blade and progressively spaced from the drum-shaped rotary blade toward the cutting edge, and a second beveled surface facing the workpiece and progressively spaced from the cutting edge away from the workpiece.

According to an aspect of the present invention, there is also provided a slitter blade assembly for cutting off a workpiece, comprising a drum-shaped rotary blade and a disk-shaped rotary blade, the drum-shaped rotary blade having a cutting edge and a third beveled surface facing the disk-shaped rotary blade and progressively spaced from the disk-shaped rotary blade toward the cutting edge.

According to another aspect of the present invention, there is further provided a slitter blade assembly for cutting off a workpiece, comprising a drum-shaped rotary blade and a disk-shaped rotary blade, the disk-shaped rotary blade having a cutting edge, a first beveled surface facing the drum-shaped rotary blade and progressively spaced from the drum-shaped rotary blade toward the cutting edge of the disk-shaped rotary blade, and a second beveled surface facing the workpiece and progressively spaced from the cutting edge of the disk-shaped rotary blade away from the workpiece, the drum-shaped rotary blade having a cutting edge and a third beveled surface facing the disk-shaped rotary blade and progressively spaced from the disk-shaped rotary blade toward the cutting edge of the drum-shaped rotary blade.

If the distance CL of the first beveled surface up to the cutting edge along a severance plane perpendicular to a surface of the workpiece may be set to a value which ranges from 40 μm to 200 μm, and the angle θ6 of the first beveled surface from the severance plane may be set to a value which ranges from 0.8° to 14°, then the slitter blade assembly can produce severed surfaces of desired shape. If the angle θ1 of the second beveled surface from the severance plane is set to a value which ranges from 65° to 85°, then since suitable tensile forces are applied to the workpiece, the workpiece can well be cut off even if the workpiece has large mechanical strength and is easily stretchable. Preferably, the distance CL should be set to a value which ranges from 60 μm to 100 μm, the angle θ6 to a value which ranges from 2.2° to 7.6°, and the angle θ1 to a value which ranges from 70° to 75°.

The disk-shaped rotary blade may have a third beveled surface. The distance HL of the third beveled surface up to the cutting edge along the severance plane may be set to a value which ranges from 25 μm to 500 μm, preferably from 70 μm to 150 μm, and the angle θ5 of the third beveled surface from the severance plane may be set to a value which ranges from 0.0° to 0.6°, preferably from 0.1° to 0.5°. The third clearance surface thus arranged allows the severed surfaces to have a better shape.

The disk-shaped rotary blade may have a first clearance surface contiguous to the first beveled surface. The angle θ3 of the first clearance surface from the severance plane may be set to a value which ranges from 2° to 5°, preferably from 3° to 4°. The first clearance surface allows severed debris to be discharged out of the slitter blade assembly and hence prevents severed debris from being attached to the rotary blades, which can keep their cutting capability over a long period of time. The drum-shaped rotary blade may have a third clearance surface contiguous to the third beveled surface. The angle θ4 of the third clearance surface from the severance plane may be set to a value which ranges from 2° to 4°. The third clearance surface is also effective to discharge severed debris out of the slitter blade assembly.

The disk-shaped rotary blade may have a second clearance surface contiguous to the second beveled surface. The angle θ2 of the second clearance surface from the severance plane may be set to a value which ranges from 20° to 45°, preferably from 25° to 35°. The second clearance surface that does not contribute to the severance of the workpiece is prevented from being pressed against the workpiece, and hence does on leave striped marks on a piece that is cut off from the workpiece. The severed piece is thus of high quality. The second beveled surface and the second clearance surface are joined to each other at a junction, and the distance L1 from the junction to the severance plane is set to a value which ranges from 0.2 mm to 0.8 mm, preferably from 0.4 mm to 0.6 mm.

The cutting edge of the disk-shaped rotary blade may have irregularities along a circumference of the disk-shaped rotary blade. The irregularities may have an irregularity quantity G set to a value which ranges from 0.5 μm to 5 μm, preferably from 1 μm to 2 μm. When the workpiece which is thin is cut off, the irregularities are effective to prevent the thin workpiece from slipping on the disk-shaped rotary blade. Therefore, the slitter blade assembly is capable of producing severed surfaces of high quality.

The disk-shaped rotary blade and/or the drum-shaped rotary blade may be made of a cemented carbide. Consequently, the disk-shaped rotary blade and/or the drum-shaped rotary blade can be resistant to undue wear and hence have their service life increased.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A web cutting device which incorporates a slitter blade assembly according to the present invention will first be described below with reference to FIG. 1.

Figure 1:
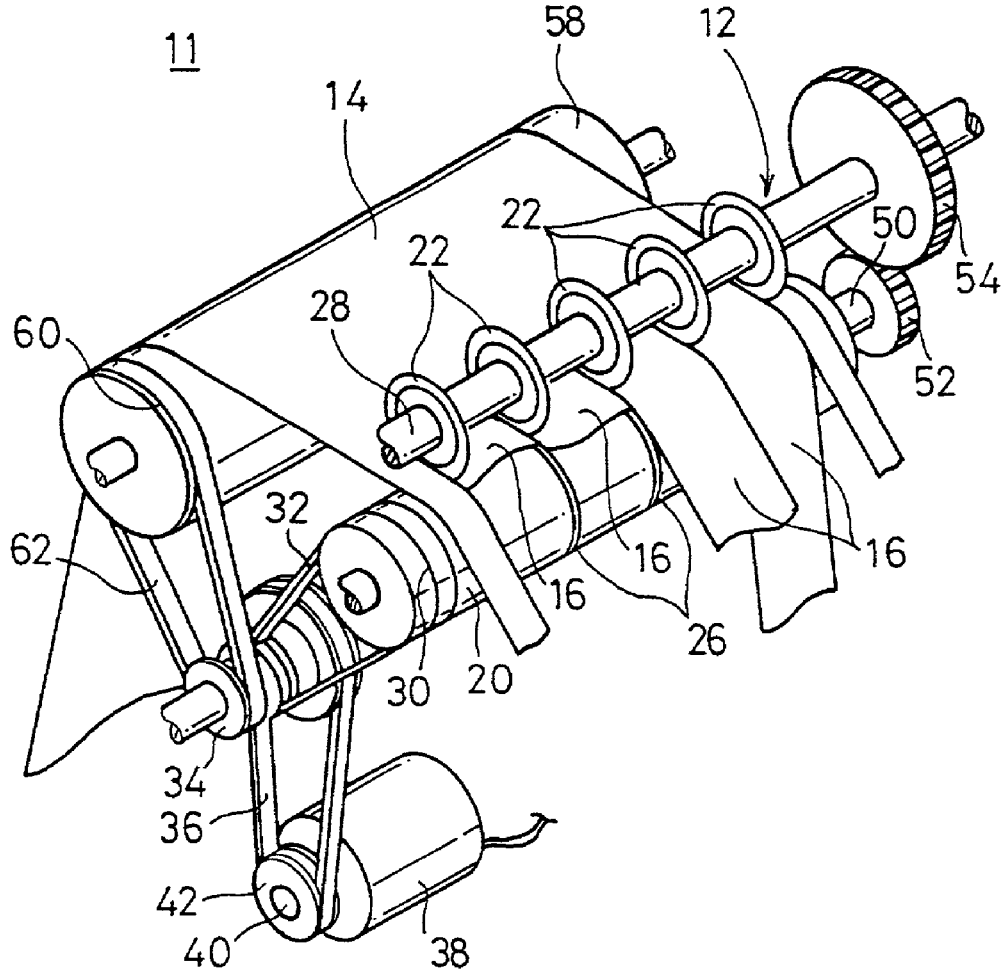
FIG. 1 is a perspective view of a web cutting device which incorporates a slitter blade assembly according to the present invention.

As shown in FIG. 1, a web cutting device 11 has a slitter blade assembly 12 for cutting off a wide web 14 such as a film, a sheet of paper, a metal foil, or the like into narrow webs 16 each of a desired width. If the wide web 14 comprises a film, then it may be a single-layer film of synthetic resin, a laminated film, an adhesive film, or the like.

The slitter blade assembly 12 comprises a drum-shaped rotary blade 20 (hereinafter referred to as "lower blade 20") and a plurality of disk-shaped rotary blades 22 (hereinafter referred to as "upper blades 22") positioned above the lower blade 20. The lower blade 20 has a plurality of annular grooves 26 defined in its circumferential surface at spaced intervals each set to the width of narrow webs 16 according to predetermined standards. Each of the upper blades 22 is fixedly mounted on a shaft 28 parallel to the lower blade 20 in vertical alignment with one of the grooves 26.

The lower blade 20 supports on one end of a shaft 50 thereof a pulley 30 fixed thereto and operatively coupled to a pulley 34 by a belt 32. The pulley 34 is operatively coupled by a belt 36 to a pulley 42 that is fixedly mounted on a drive shaft 40 of a motor 38. When the motor 38 is energized, the rotation of the shaft 40 is transmitted from the pulley 42 through the belt 36, the pulley 34, the belt 32, and the pulley 30 to the lower blade 20, which is then rotated about its own axis.

Figure 2:
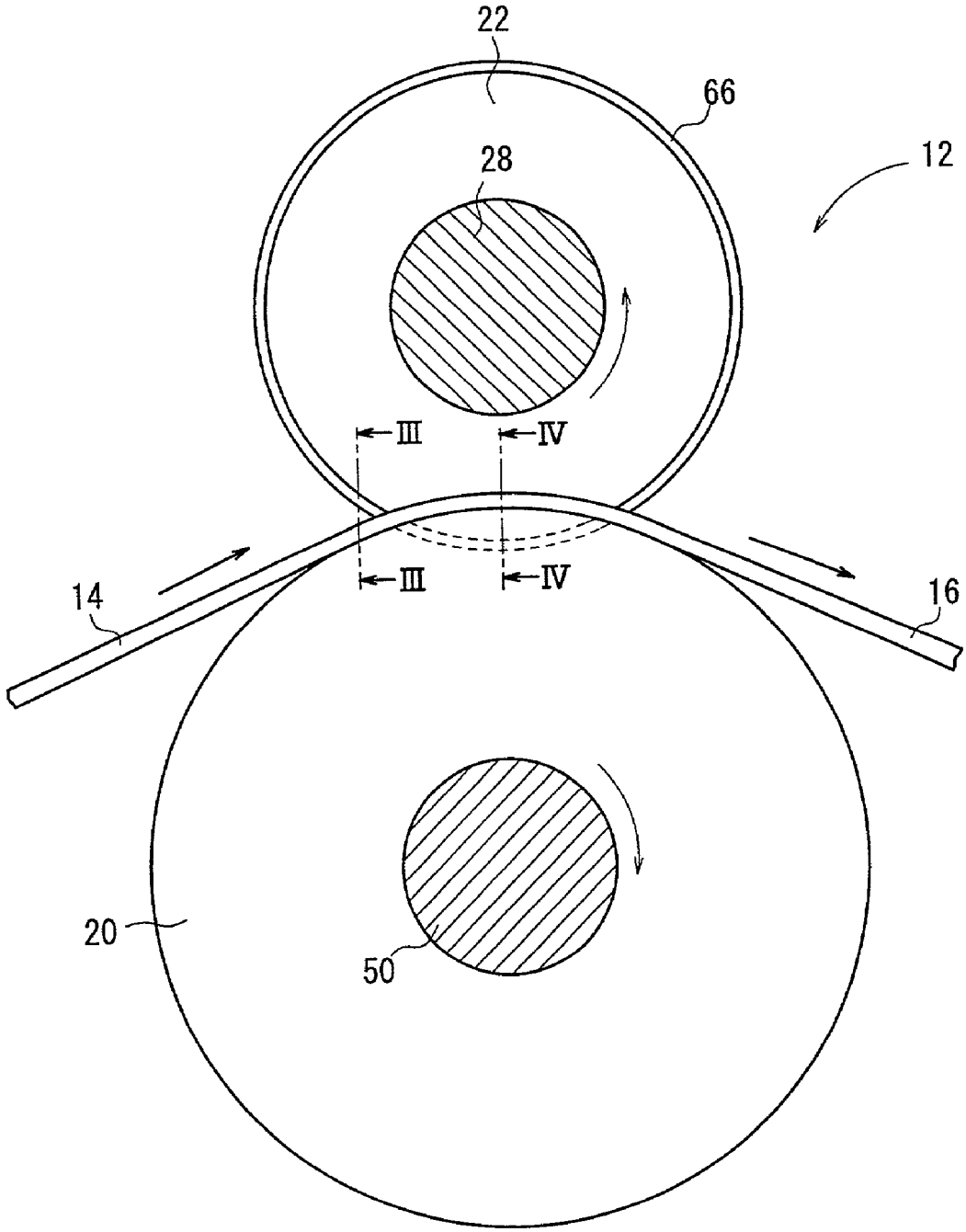
FIG. 2 is an enlarged side elevational view of the slitter blade assembly shown in FIG. 1.

The shaft 50 of the lower blade 20 supports a gear 52 fixed thereto which is held in mesh with a gear 54 mounted on an end portion of the shaft 28 that supports the upper blades 22 thereon. Therefore, when the lower blade 20 rotates, the upper blades 22 rotate in unison therewith. While the upper blades 22 and the lower blade 20 are rotating, the upper blades 22 have outer circumferential edges entering the respective grooves 26 in the lower blade 20 and held in sliding contact with the corresponding circumferential edges of the lower blade 20 at the respective grooves 26, thus cutting off the wide web 14 into narrow webs 16 each having a width equal to the distance between adjacent ones of the grooves 26 and the upper blades 22 (see FIG. 2).

A web feed roller 58 is disposed upstream of the slitter blade assembly 12 with respect to the direction in which the wide web 14 is supplied to the slitter blade assembly 12. The wide web 14 is fed from a web supply roll, not shown, and travels around the web feed roller 58 to the slitter blade assembly 12. A pulley 60 is fixedly mounted on an end of the web feed roller 58 and operatively coupled to the pulley 34 by a belt 62. When the motor 38 is energized, the rotation of the shaft 40 is transmitted from the pulley 42 through the belt 36, the pulley 34, the belt 62, and the pulley 60 to the web feed roller 58, which rotates about its own axis. Therefore, the web feed roller 58 rotates in unison with the slitter blade assembly 12, thus supplying the wide web 14 to the slitter blade assembly 12.

Details of the slitter blade assembly 12 will be described below.

Figure 3:
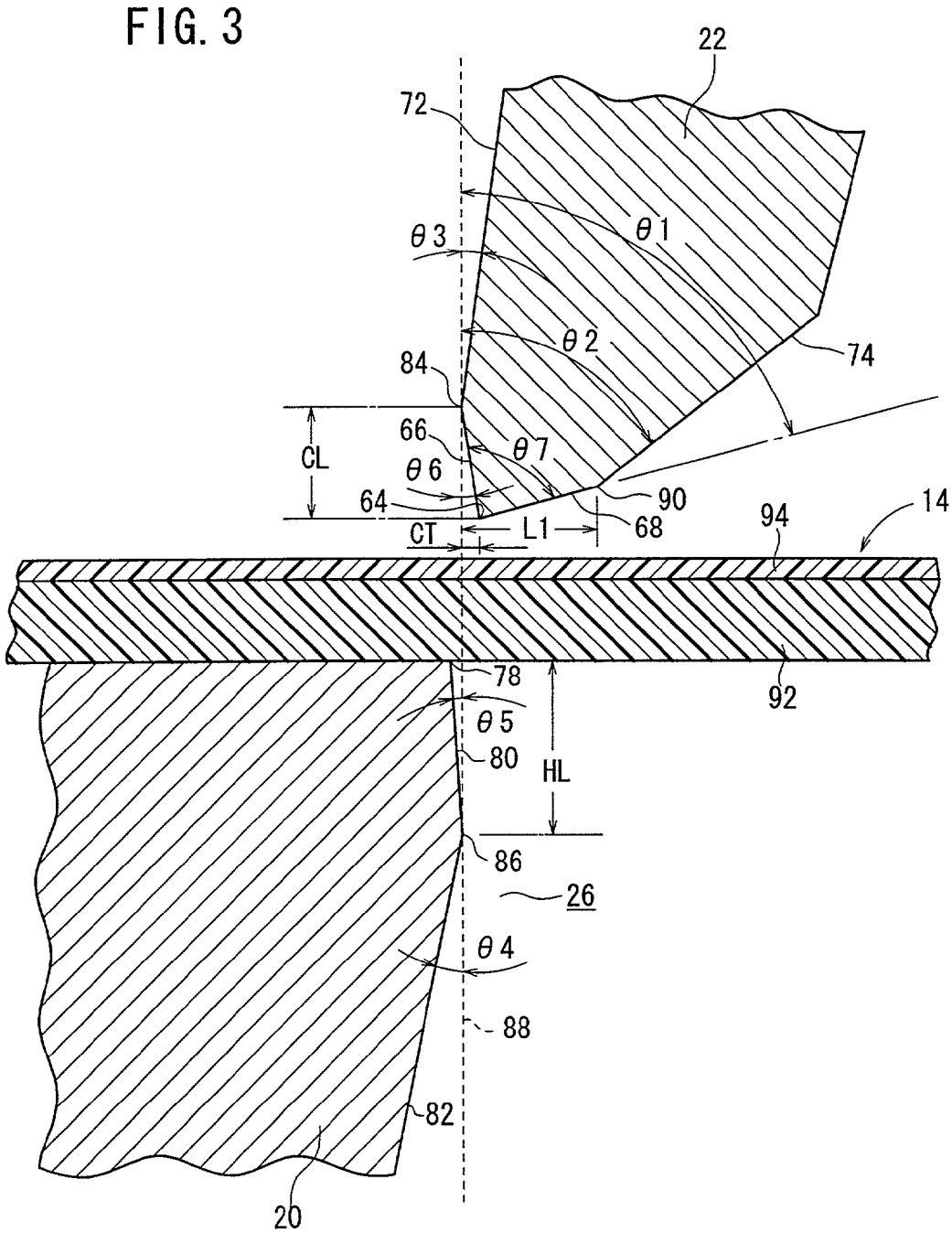
FIG. 3 is an enlarged cross-sectional view taken along line III-III of FIG. 2.
Figure 4:
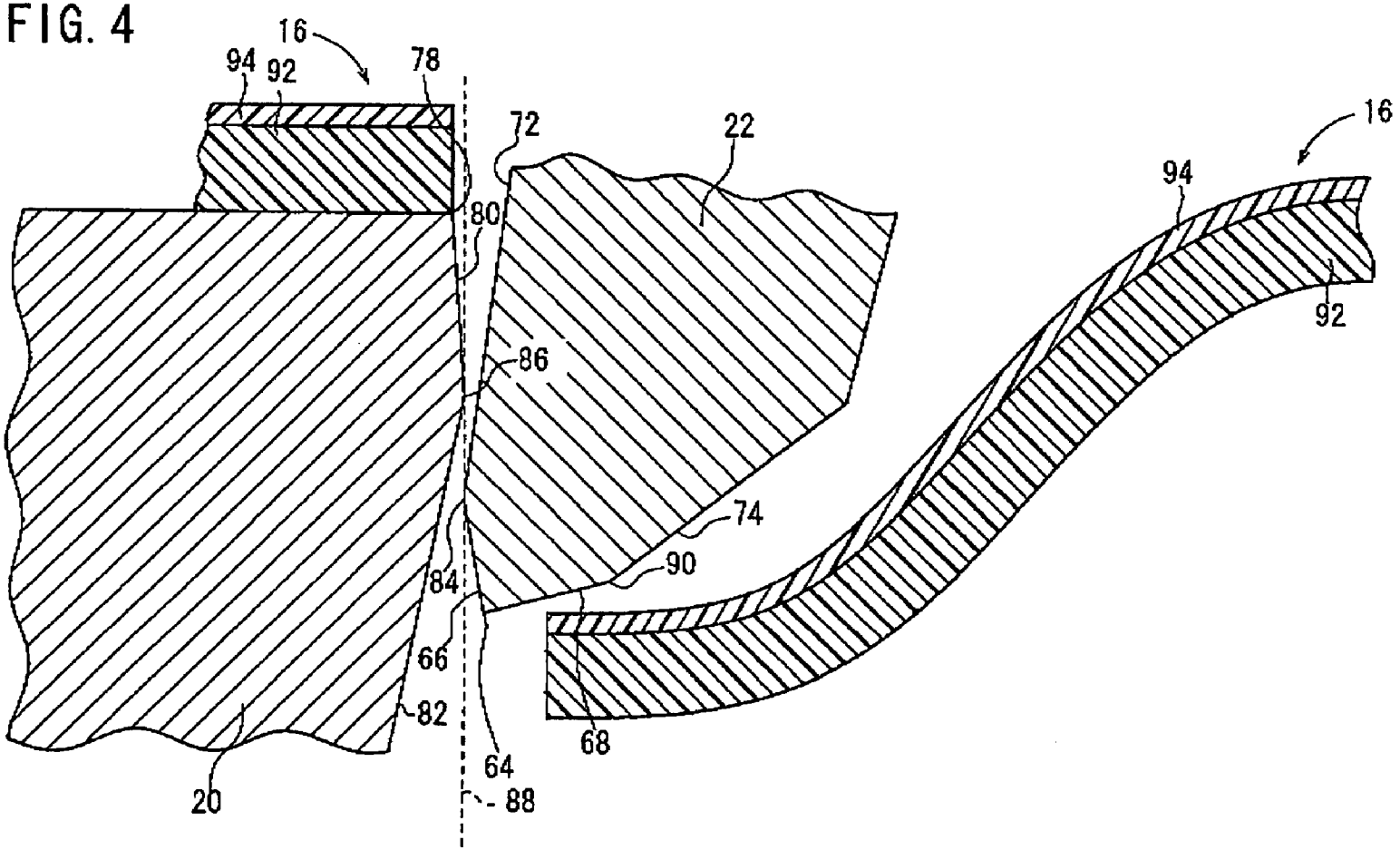
FIG. 4 is an enlarged cross-sectional view taken along line IV-IV of FIG. 2.
Figure 5:
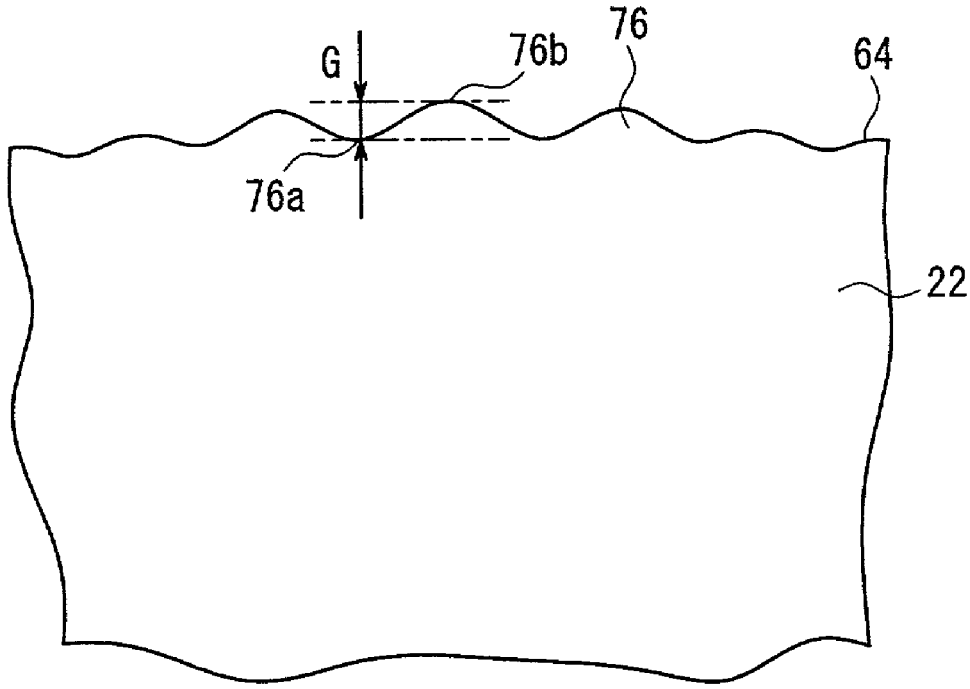
FIGS. 5 and 8 are partial enlarged views of an upper blade of the slitter blade assembly in the vicinity of a cutting edge thereof.
Figure 6:
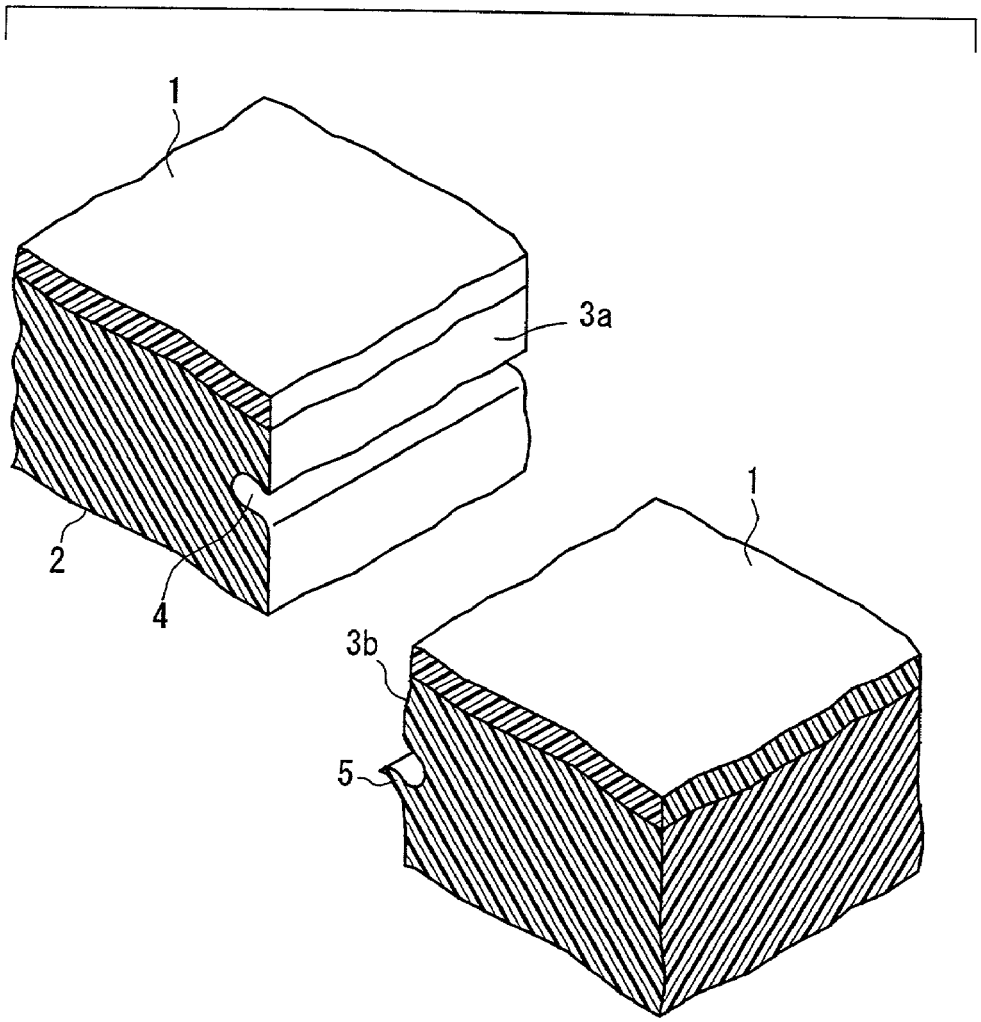
FIG. 6 is a fragmentary perspective view showing a crack and a whisker that are formed on severed surfaces of a workpiece that is cut off by a conventional rotary blade assembly.
Figure 7:
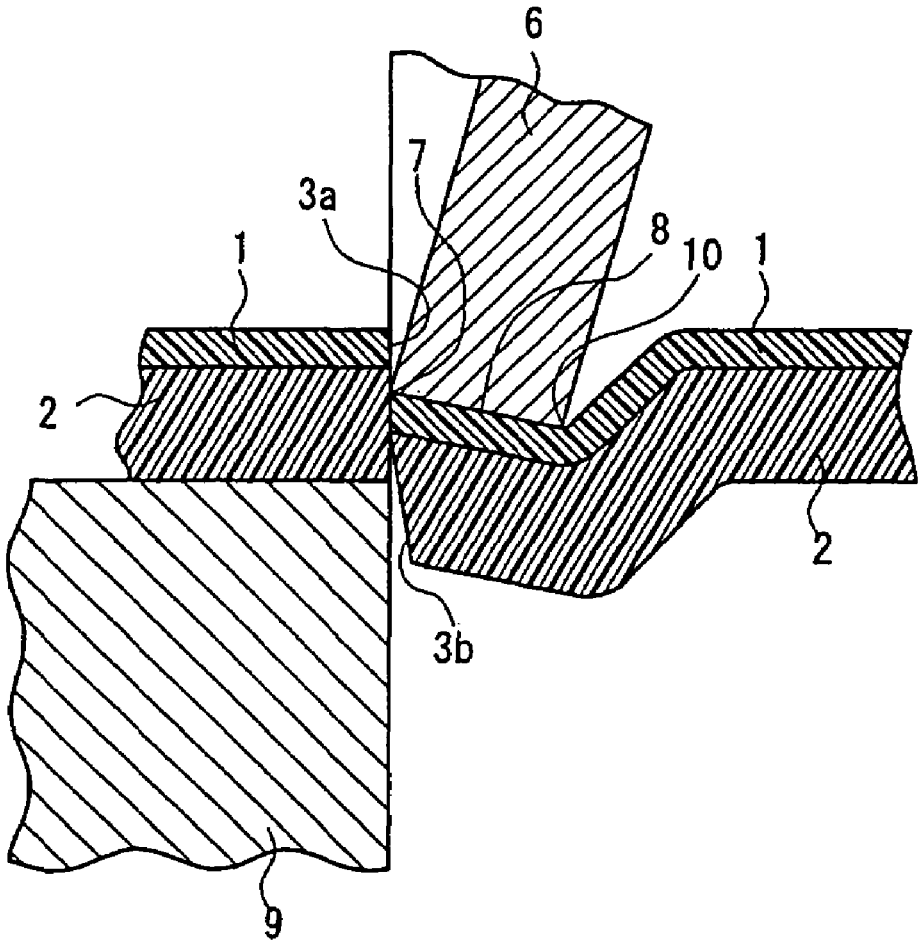
PRIOR ART FIG. 7
FIG. 7 is a fragmentary cross-sectional view showing the manner in which a workpiece is a cut off by a conventional rotary blade assembly.
Figure 8:
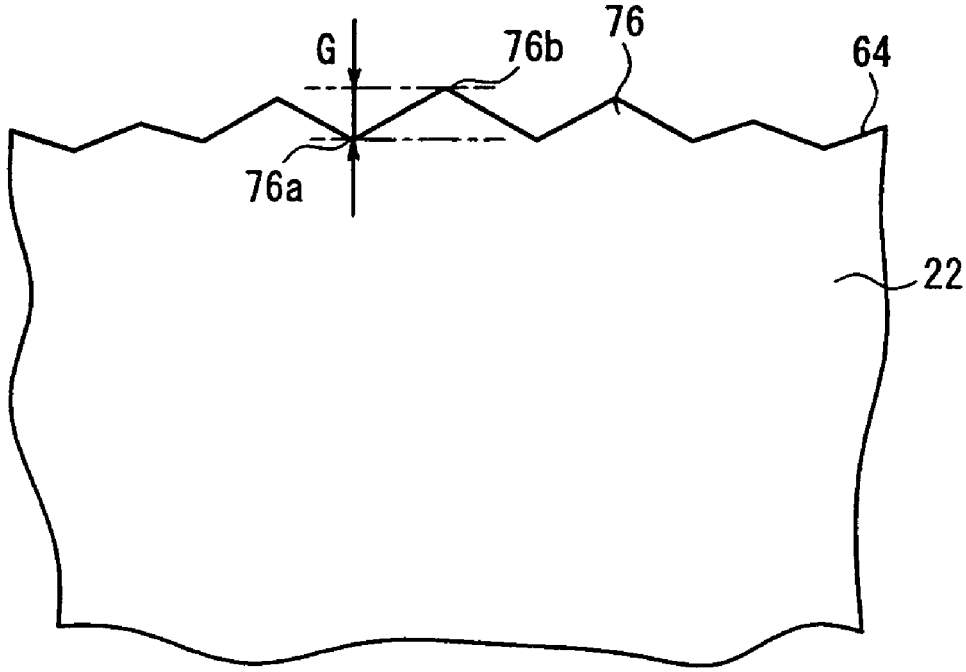

As shown in FIGS. 3 and 4, each of the upper blades 22 has a first beveled surface 66 and a second beveled surface 68 extending from a cutting edge 64 which is the outermost circumferential edge of the upper blade 22. The first beveled surface 66 is disposed on a side of the upper blade 22 which faces the lower blade 20, and the second beveled surface 68 is disposed on a side of the upper blade 22 which faces the wide web 14. Each of the upper blades 22 also has a first clearance surface 72 contiguous to the first beveled surface 66 and a second clearance surface 74 contiguous to the second beveled surface 68. As shown in FIGS. 5 and 8, the cutting edge 64 has saw-toothed or undulated irregularities 76 along the circumference of the upper blade 22. The saw-toothed or undulated irregularities 76 may be formed by a lapping or polishing process.

The lower blade 20 has a third beveled surface 80 extending from a cutting edge 78 facing each of the grooves 26 and a third clearance surface 82 contiguous to the third beveled surface 80.

Table 1, given later on, shows dimensions that can be employed and preferred dimensions of the various parts of each of the upper blades 22. The first beveled surface 66 and the first clearance surface 72 of the upper blade 22 are joined to each other at a junction 84, and the third beveled surface 80 and the third clearance surface 82 of the lower blade 20 are joined to each other at a junction 86. A straight line interconnecting the junctions 84, 86 is defined as a severance plane 88. With respect to the first beveled surface 66, the distance CL from the junction 84 to the cutting edge 64 along the severance plane 88 is set to a value which ranges from 40 μm to 200 μm, preferably from 60 μm to 100 μm, and the distance CT from the severance plane 88 to the cutting edge 64 is set to a value which ranges from 3 μm to 10 μm, preferably from 4 μm to 8 μm. The angle θ6 of the first beveled surface 66 from the severance plane 88 is set to a value which ranges from 0.8° to 14°, preferably from 2.2° to 7.6°. The angle θ1 of the second beveled surface 68 from the severance plane 88 is set to a value which ranges from 65° to 85°, preferably from 70° to 75°. The angle θ7 of the cutting edge 64 between the first beveled surface 66 and the second beveled surface 68 is set to a value which ranges from 65.8° to 99°, preferably from 72.2° to 82.6°.

The angle θ3 of the first clearance surface 72 from the severance plane 88 is set to a value which ranges from 2° to 5°, preferably from 3° to 4°. The angle θ2 of the second clearance surface 74 from the severance plane 88 is set to a value which ranges from 20° to 45°, preferably from 25° to 35°. The distance L1 from a junction 90 between the second beveled surface 68 and the second clearance surface 74 to the severance plane 88 is set to a value which ranges from 0.2 mm to 0.8 mm, preferably from 0.4 mm to 0.6 mm.

The irregularities 76 on the cutting edge 64 of each of the upper blades 22 include concavities 76*a* and convexities 76*b*. An irregularity quantity G, which represents the height from the bottom of the concavities 76*a* to the crest of the convexities 76*b*, is set to a value which ranges from 0.5 μm to 5 μm, preferably from 1 μm to 2 μm.

Table 2, given later on, shows materials of the upper blades 22 and the lower blade 20. Each of the upper blades 22 and the lower blade 20 is made of a cemented carbide. Specifically, products A, B, C are shown by way of example as preferred materials of the upper blades 22 and the lower blade 20. The product A comprises 84.75 weight % of WC, 13 weight % of Co, 0.75 weight % of $Cr_3C_2$, and 1.5 weight % of TaC. The product B comprises 83 weight % of WC, 16 weight % of Co, 0.5 weight % of $Cr_3C_2$, and 0.5 weight % of VC. The product C comprises 82 weight % of WC, 12 weight % of Co, 5.4 weight % of TiC, 0.8 weight % of VC, and 0.3 weight % of other elements. Table 3, given later on, shows properties of the products A, B, C.

Table 4, given later on, shows dimensions that can be employed and preferred dimensions of the various parts of the lower blade 20. With respect to the third beveled surface 80, the distance HL from the junction 86 to the cutting edge 78 along the severance plane 88 is set to a value which ranges from 25 μm to 500 μm, preferably from 70 μm to 150 μm. The angle θ5 of the third beveled surface 80 from the severance plane 88 is set to a value which ranges from 0.0° to 0.6°, preferably from 0.1° to 0.5°. The angle θ4 of the third clearance surface 82 from the severance plane 88 is set to a value which ranges from 2° to 4°, preferably to 3°.

The web cutting device 11 is basically constructed as described above. Operation and advantages of the web cutting device 11 will be described below.

When the motor 38 is energized to rotate the drive shaft 40, the rotation of the drive shaft 40 is transmitted through the pulley 42 and the belt 36 to the pulley 34. The rotation of the pulley 34 is transmitted through the belt 62 and the pulley 60 to the web feed roller 58, which then rotates about its own axis to supply the wide web 14 to the slitter blade assembly 12.

The rotation of the pulley 34 is also transmitted through the belt 32 and the pulley 30 to the lower blade 20, which then rotates. The rotation of the lower blade 20 is transmitted through the gears 52, 54 to the upper blades 22, which rotate in unison with the lower blade 20. At this time, the wide web 14 supplied from the web feed roller 58 to the slitter blade assembly 12 is cut off into narrow webs 16 by the lower blade 20 and the upper blades 22.

It is assumed that the wide web 14 and hence the narrow webs 16 severed from the wide web 14 have a PEN base for use in an APS film or the like. Specifically, each of the wide web 14 and the narrow webs 16 comprises a PEN base 92 coated with an emulsion layer 94 on its upper surface, as shown in FIGS. 3 and 4.

When the wide web 14 enters between the upper blades 22 and the lower blade 20, the upper blades 22 and the lower blade 20 rotate in unison with each other to displace their cutting edges 64, 78 progressively toward each other from the positions shown in FIG. 3 as the wide web 14 progresses. First, the cutting edge 64 of each of the upper blades 22 contacts the wide web 14. Then, the cutting edge 64 imparts shearing stresses to the wide web 14, and the second beveled surface 68 presses the emulsion layer 94 of the wide web 14, applying tensile forces to the wide web 14 in a direction perpendicular to the severance plane 88. The upper blade 22 then bites into the corresponding groove 26 in the lower blade 20, thus cutting off the wide web 14 into the narrow web 16, as shown in FIG. 4.

Since the distance CT from the cutting edge 64 to the severance plane 88, which is determined by the distance CL and the angle θ6, is set to the ranges shown in Table 1, the upper blade 22 exhibits a highly sharp cutting capability. The irregularities 76 on the cutting edge 64 whose irregularity quantity G is set to the ranges shown in Table 1 is effective to prevent the wide web 14 from slipping on the upper blade 22, allowing the narrow web 16 to have severed surfaces of high quality. Because the angle θ2 of the second clearance surface 74 from the severance plane 88 is set to the ranges shown in Table 1, the second clearance surface 74 that does not contribute to the severance of the wide web 14 is prevented from being pressed against the emulsion layer 94 while the wide web 14 is being severed. Therefore, the severed narrow webs 16 are free from striped marks, and hence are of high quality.

In the vicinity of the cutting edge 78 of the lower blade 20, the third beveled surface 80 has the angle θ5 and the distance HL set to the ranges shown in Table 4. The third beveled surface 80 thus arranged is effective to prevent the cutting edge 78 from chipping. Therefore, the lower blade 20 has a prolonged service life.

The first clearance surface 72 is contiguous to the first beveled surface 66 of the upper blade 22, and the third clearance surface 82 is contiguous to the third beveled surface 80 of the lower blade 20. The first clearance surface 72 and the third clearance surface 82 are capable of discharging severed debris, which is produced when the wide web 14 is severed, out of the slitter blade assembly 12. Since such severed debris is discharged, but not attached to the upper blade 22 and the lower blade 20, their cutting capability is not lowered by such severed debris, and hence the service life of the slitter blade assembly 12 is increased.

Inasmuch as the upper blade 22 and the lower blade 20 are made of a cemented carbide whose compositions are shown in Table 2, the upper blade 22 and the lower blade 20 are resistant to undue wear and hence have their service life increased. If the angle θ7 of the angle cutting edge 64 of the upper blade 22 is set to a small value, then the lower blade 20 may be made of a cemented carbide and the upper blade 22 may be made of a high-speed steel such as SKH2 or the like for the purpose of avoiding chipping.

While the present invention has been illustrated as being applied to a slitter blade assembly, the principles of the present invention are also applicable to any of various blades.

TABLE 1

| | Dimensions that can be employed | Preferred dimensions |
|---|---|---|
| θ1 | 65°-85° | 70°-75° |
| θ6 | 0.8°-14° | 2.2°-7.6° |
| θ2 | 20°-45° | 25°-35° |
| θ3 | 2°-5° | 3°-4° |
| θ7 | 65.8°-99° | 72.2°-82.6° |
| CL | 40 μm-200 μm | 60 μm-100 μm |
| CT | 3 μm-10 μm | 4 μm-8 μm |
| Irregularity quantity G | 0.5 μm-5 μm | 1 μm-2 μm |
| L1 | 0.2 mm-0.8 mm | 0.4 mm-0.6 mm |

TABLE 2

| Product | WC | Co | $Cr_3C_2$ | TaC | TiC | VC | Others |
|---|---|---|---|---|---|---|---|
| A | 84.75 wt % | 13 wt % | 0.75 wt % | 1.5 wt % | — | — | — |
| B | 83 wt % | 16 wt % | 0.5 wt % | — | — | 0.5 wt % | — |
| C | 82 wt % | 12 wt % | — | — | 5.4 wt % | 0.8 wt % | 0.3 wt % |

TABLE 3

| Product | A | B | C |
|---|---|---|---|
| Specific gravity (g/cm$^3$) | 14.1 | 13.6 | 14.2 |
| Hardness (HRA) | 91.4 | 91.5 | 91.5 |
| Flexural strength (MPa) | 3234 | 2940 | 3038 |
| Average particle diameter of WC (μm) | 0.7 | 0.6 | 0.7 |
| Young's modulus (×10$^4$ MPa) | 54.88 | 49.98 | 55.86 |
| Coefficient of thermal expansion (×10$^{-6}$/K) | 4.9 | 5.6 | 5.5 |
| Thermal conductivity (W/m · K) | 0.00419 | 0.006285 | 0.006704 |

TABLE 4

| | Dimensions that can be employed | Preferred dimensions |
|---|---|---|
| θ4 | 2°-4° | 3° |
| θ5 | 0.0°-0.6° | 0.1°-0.5° |
| HL | 25 μm-500 μm | 70 μm-150 μm |

Although a certain preferred embodiment of the present invention has been shown and described in detail, it should be understood that various changes and modifications may be made therein without departing from the scope of the appended claims.

What is claimed is:

1. A slitter blade assembly for cutting off a workpiece, comprising:

a drum-shaped rotary blade; and a disk-shaped rotary blade;

said disk-shaped rotary blade having a cutting edge, a first beveled surface facing said drum-shaped rotary blade and progressively spaced from said drum-shaped rotary blade toward said cutting edge, and a second beveled surface facing the workpiece and progressively spaced from said cutting edge away from the workpiece, wherein a first distance (CL) of said first beveled surface up from said cutting edge along a severance plane perpendicular to a surface of the workpiece is set to a value which ranges from 40 μm to 200 μm and a first angle (q6) of said first beveled surface from said severance plane is set to a value which ranges from 0.8° to 14°.

2. A slitter blade assembly according to claim 1, wherein a second angle (q1) of said second beveled surface from said severance plane is set to a value which ranges from 65° to 85°.

3. A slitter blade assembly according to claim 2, wherein said disk-shaped rotary blade has a first clearance surface contiguous to said first beveled surface, and a third angle (q3) of said first clearance surface from said severance plane is set to a value which ranges from 2° to 5°.

4. A slitter blade assembly according to claim 2, wherein said disk-shaped rotary blade has a second clearance surface contiguous to said second beveled surface, and a fourth angle (q2) of said second clearance surface from said severance plane is set to a value which ranges from 20° to 45°.

5. A slitter blade assembly according to claim 4, wherein said second beveled surface and said second clearance surface are joined to each other at a junction, and a second distance (L1) from said junction to said severance plane is set to a value which ranges from 0.2 mm to 0.8 mm.

6. A slitter blade assembly according to claim 1, wherein said disk-shaped rotary blade and/or said drum-shaped rotary blade is made of a cemented carbide.

7. A slitter blade assembly according to claim 1, wherein said cutting edge is spaced apart from the severance plane perpendicular to a surface of the workpiece.

8. A slitter blade assembly according to claim 1, further comprising a means for rotating the drum-shaped rotary blade in unison with the disk-shaped rotary blade.

9. A slitter blade assembly for cutting off a workpiece, comprising:

a drum-shaped rotary blade; and a disk-shaped rotary blade;

said disk-shaped rotary blade having a cutting edge, a first beveled surface facing said drum-shaped rotary blade and progressively spaced from said drum-shaped rotary blade toward said cutting edge, and a second beveled surface facing the workpiece and progressively spaced from said cutting edge away from the workpiece, wherein the drum-shaped rotary blade is disposed on a drum shaft, the disk-shaped rotary blade is disposed on a disk shaft, and the slitter blade assembly further comprising means for transmitting driving force between the drum shaft and the disk shaft, wherein a first distance (CL) of said first beveled surface up from said cutting edge along a severance plane perpendicular to a surface of the workpiece is set to a value which ranges from 40 μm to 200 μm and a first angle (q6) of said first beveled surface from said severance plane is set to a value which ranges from 0.8° to 14°.

10. A slitter blade assembly according to claim 9, wherein the drum shaft and the disk shaft are operably connected to rotate in unison.

11. A slitter blade assembly according to claim 9, wherein the means for transmitting the driving force comprises gears.

12. A slitter blade assembly according to claim 9, wherein the drum-shaped rotary blade comprises at least one groove and the disk-shaped rotary blade is operable to enter the at least one groove of the drum-shaped rotary blade.

13. A slitter blade assembly according to claim 9 further comprising a plurality of disk-shaped rotary blades, wherein the disk-shaped rotary blade is one of a plurality of a disk-shaped rotary blades, the drum-shaped rotary blade comprises a plurality of grooves, each of the plurality of disk-shaped rotary blades corresponding to one of the plurality of grooves.

14. A slitter blade assembly according to claim 13, wherein the plurality of grooves are disposed on a surface of the drum-shaped rotary blade.

* * * * *